US008572803B2

(12) United States Patent
Inge et al.

(10) Patent No.: US 8,572,803 B2
(45) Date of Patent: Nov. 5, 2013

(54) SUPPORT ASSEMBLY

(75) Inventors: Douglas Andrew Inge, Malmesbury (GB); Stephen Benjamin Courtney, Malmesbury (GB)

(73) Assignee: Dyson Technology Limited, Malmesbury (GB)

( * ) Notice: Subject to any disclaimer, the term of this patent is extended or adjusted under 35 U.S.C. 154(b) by 928 days.

(21) Appl. No.: 12/439,442

(22) PCT Filed: Aug. 23, 2007

(86) PCT No.: PCT/GB2007/003213

§ 371 (c)(1), (2), (4) Date: Aug. 4, 2009

(87) PCT Pub. No.: WO2008/025956

PCT Pub. Date: Mar. 6, 2008

(65) Prior Publication Data

US 2009/0300875 A1 Dec. 10, 2009

(30) Foreign Application Priority Data

Sep. 1, 2006 (GB) ..... 0617184.7
Dec. 22, 2006 (GB) ..... 0625763.8

(51) Int. Cl.
*A47L 5/34* (2006.01)
*A47L 5/00* (2006.01)
*A47L 9/00* (2006.01)

(52) U.S. Cl.
USPC ..... 15/354; 15/411; 15/327.2

(58) Field of Classification Search
USPC ..... 15/354, 411, 327.2
See application file for complete search history.

(56) References Cited

U.S. PATENT DOCUMENTS 2,918,693 A * 12/1959 Gasparini ..... 15/323
3,401,952 A 9/1968 Johanson et al.
4,023,332 A 5/1977 Achenbach et al.
4,809,395 A 3/1989 Fleischhauer
5,056,871 A 10/1991 Sbarro
5,794,305 A 8/1998 Weger
6,357,765 B1 3/2002 Heien (Continued)

FOREIGN PATENT DOCUMENTS

EP 1129657 9/2001
EP 1250880 10/2002

(Continued)

OTHER PUBLICATIONS

British Search Report completed on Nov. 14, 2006 directed towards foreign application No. GB0617184.7; 1 page.

(Continued)

*Primary Examiner* — Bryan R Muller
(74) *Attorney, Agent, or Firm* — Morrison & Foerster LLP

(57) ABSTRACT

A support assembly for a surface treating appliance includes a central roller arranged to engage a surface and outer rollers at either end of the central roller. The rollers together define a rolling support surface, and the outer rollers rotate about an axis spaced from the rotational axis of the central roller. This arrangement of rollers provides a rolling support surface over a wide range of motions, and spacing the rotational axes of the rollers permits the rollers to be arranged relative to one another to define a region into which components of the appliance are mountable.

19 Claims, 10 Drawing Sheets

(56) References Cited

U.S. PATENT DOCUMENTS

| | | | | |
|---|---|---|---|---|
| 6,536,073 | B2 * | 3/2003 | Uratani et al. | 15/327.4 |
| D600,416 | S * | 9/2009 | Shin et al. | D32/21 |
| 2001/0018780 | A1 | 9/2001 | Hashizume et al. | |
| 2005/0235454 | A1 * | 10/2005 | Courtney | 15/351 |

FOREIGN PATENT DOCUMENTS

| | | | |
|---|---|---|---|
| EP | 1250880 | A1 * | 10/2002 |
| GB | 757663 | | 9/1956 |
| GB | 2290462 | | 1/1996 |
| GB | 2383019 | | 6/2003 |
| GB | 2391459 | | 2/2004 |
| GB | 2422094 | | 7/2006 |
| GB | 2422094 | A * | 7/2006 |
| JP | 4-327814 | | 11/1992 |
| JP | 2002-360470 | | 12/2002 |
| WO | WO-95/03200 | | 2/1995 |
| WO | WO-2004/014211 | | 2/2004 |
| WO | WO-2006/077382 | | 7/2006 |
| WO | WO-2007/028049 | | 3/2007 |

OTHER PUBLICATIONS

British Search Report completed on Mar. 16, 2007 directed towards foreign application No. GB0625763.8; 1 page.

International Preliminary Report on Patentability completed on Dec. 10, 2008 directed towards international application No. PCT/GB2007/003213; 7 pages.

International Search Report and Written Opinion mailed on Dec. 27, 2007 directed towards international application No. PCT/GB2007/003213; 10 pages.

* cited by examiner

SUPPORT ASSEMBLY

REFERENCE TO RELATED APPLICATIONS

This application is a national stage application under 35 US 371 of International Application No. PCT/GB2007/003213, filed Aug. 23, 2007, which claims the priority of United Kingdom Application Nos. 0617184.7 and 0625763.8, filed Sep. 1 and Dec. 22, 2006, respectively, the contents of which prior applications are incorporated herein by reference.

FIELD OF THE INVENTION

This invention relates to a support assembly for a surface treating head or a surface treating appliance, such as a vacuum cleaner.

Surface treating appliances such as vacuum cleaners and floor polishers are well known. The majority of vacuum cleaners are either of the 'upright' type or of the 'cylinder' type, called canister or barrel cleaners in some countries. An example of an upright vacuum cleaner manufactured by Dyson Limited under the name DC15 ("DC15" is a trade mark of Dyson Limited) is shown in FIG. 1. The vacuum cleaner, indicated generally by the reference numeral 1, comprises a main body 2, which houses the main components of the vacuum cleaner, including separating apparatus 3 for separating dirt, dust and other debris from a dirty airflow drawn in by a motor-driven fan (not visible in this drawing). A cleaner head 4 is mounted to the lower end of the main body 2.

Also at the lower end of the main body 2 is a support assembly in the form of a barrel-shaped roller 5. The roller 5 permits the cleaner 1 to be easily manoeuvred. In use, a user reclines the main body 2 of the vacuum cleaner 1 and then pushes and pulls a handle 6 which is fixed to the main body of the cleaner. The vacuum cleaner 1 rolls along the floor surface on the roller 5, and may be steered by the user twisting the handle 6 about its longitudinal axis 8. This cleaner 1 is much more manoeuvrable than previous cleaners employing wheels. Various components of the cleaner are mounted within the roller 5 as a space-saving measure.

A problem which may be encountered with this appliance is that connections have to be made between the components mounted inside the roller 5 and other components on the cleaner 1. For example, where the roller 5 houses filters and other components that act on fluid being drawn into the appliance, ducts 7*a*, 7*b* have to be provided in order to create a fluid flow path between those components inside the roller 5 and those of the separating apparatus 3 on the main body 2. A good sealing connection has to be provided between these rigid ducts 7*a*, 7*b* and the rotatable roller 5, and a special bearing has to be provided to accommodate the ducts.

SUMMARY OF THE INVENTION

The invention provides a support assembly for a surface treating appliance or a surface treating head comprising a plurality of rollers defining a rolling support surface, the rollers comprising a central roller arranged to engage a floor surface and a pair of outer rollers at respective ends of the central roller, each outer roller having a rotational axis spaced from that of the central roller.

This arrangement of a central roller and outer rollers provides a substantially continuous symmetrical rolling support surface over a wide range of motions. Spacing the rotational axes of the rollers permits the rollers to be arranged relative to one another to define a region into which components of the appliance or head are mountable.

Preferably, the outer rollers have a common rotational axis to provide a symmetrical support surface. However, the outer rollers may have separate rotational axes spaced from each other.

Advantageously, when the support assembly is in an upright position, with the rotational axis of its central roller parallel with a floor or other surface to be treated, the rotational axis or axes of the outer rollers is vertically higher than that of the central roller.

It is preferable that the maximum diameter of the central roller is less than the maximum diameter of each outer roller.

The central roller may be elongated and barrel-shaped, so that it is wider at its central portion than at the ends. This shape gives good stability.

Any or all of the rollers of the support assembly may be made up of a plurality of roller members.

The invention further provides a surface treating appliance, such as a vacuum cleaner, incorporating such a rolling support assembly.

The invention further provides a surface treating head incorporating such a rolling support assembly.

The term "surface treating appliance" is intended to have a broad meaning, and includes a wide range of machines having a head for travelling over a surface to clean or treat the surface in some manner. It includes, inter alia, machines which apply suction to the surface so as to draw material from it, such as vacuum cleaners (dry, wet and wet/dry), as well as machines which apply material to the surface, such as polishing/waxing machines, pressure washing machines, ground marking machines and shampooing machines. It also includes lawn mowers and other cutting machines.

Use of the term "roller" is intended to encompass wheels and rolling surfaces in general.

BRIEF DESCRIPTION OF THE DRAWINGS

The invention will now be described, by way of example, with reference to the accompanying drawings, in which.

Like reference numerals refer to like parts throughout the specification.

DETAILED DESCRIPTION OF THE INVENTION

Figure 2:
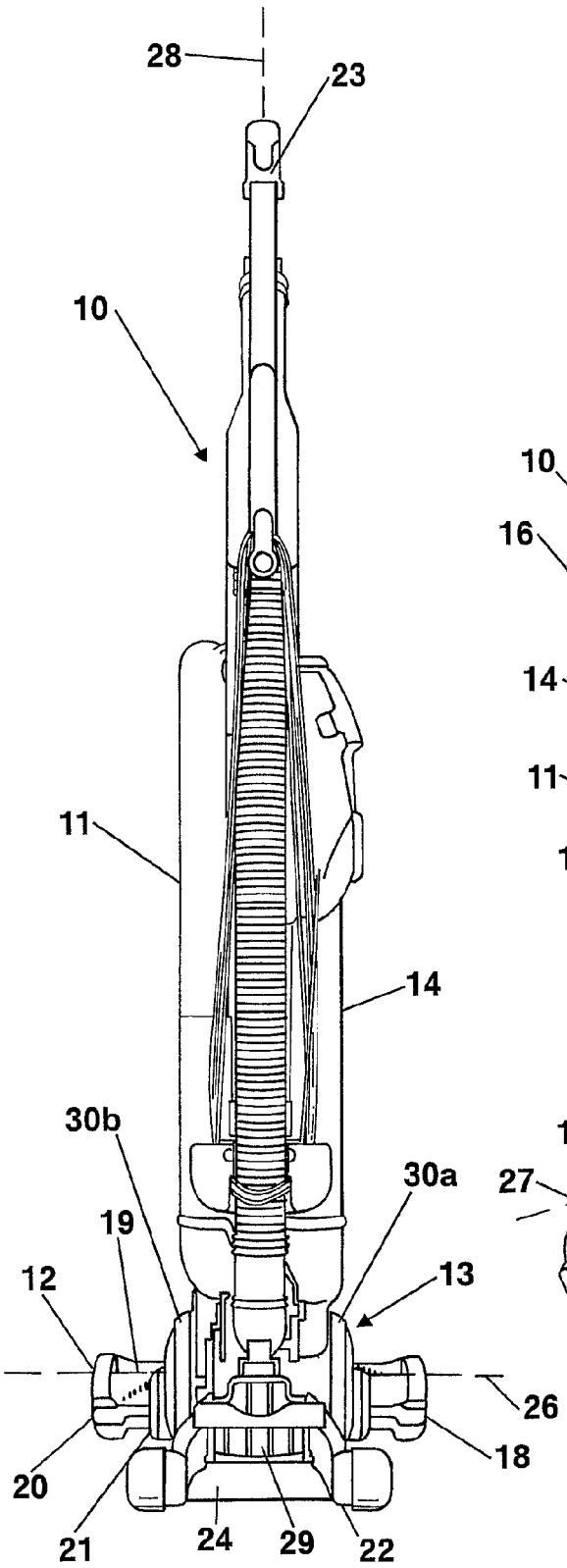
FIG. 2 is a rear view of a vacuum cleaner incorporating a support assembly constructed according to the invention.
Figure 3:
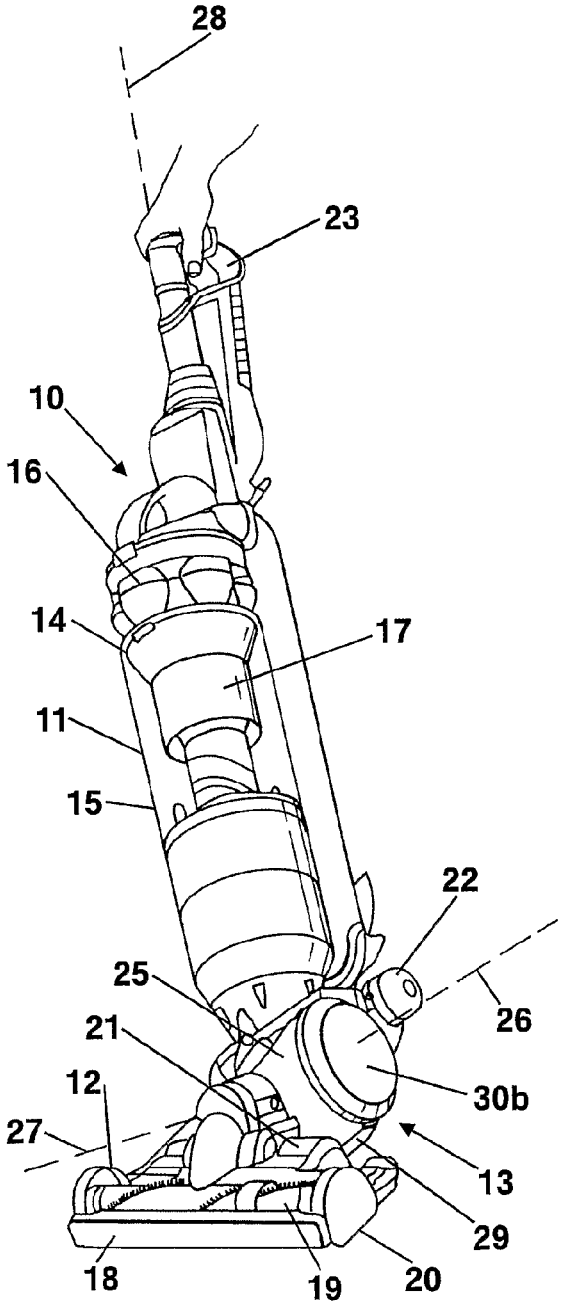
FIG. 3 is a perspective view of the vacuum cleaner of FIG. 2 in use.

With reference to FIGS. 2 and 3, a surface treating appliance is shown in the form of a vacuum cleaner and is indicated generally by the reference numeral 10. The vacuum cleaner 10 comprises a main body 11, a cleaner head 12 and a rolling support assembly 13 for rolling the cleaner along a floor surface. The main body 11 houses a motor and fan for generating a suction airflow (not visible in these drawings) as well as separating apparatus 14 for separating dirt, dust and other debris from a dirty airflow drawn into the machine by the fan and motor.

In this embodiment, the separating apparatus 14 is cyclonic, in which the dirt and dust is spun from the airflow. The cyclonic separating apparatus 14 comprises two stages of cyclone separation arranged in series with one another. The first stage is a cylindrically-walled chamber 15 and the second stage comprises a set 16 of tapering, substantially frusto-conically shaped chambers arranged in parallel with one another. Airflow is directed tangentially into the upper part of the chamber 15. Larger debris and particles are removed and collected in the chamber 15. The airflow then passes through a shroud 17 to the set 16 of smaller frusto-conically shaped cyclonic chambers. Finer dust is separated by these chambers and the separated dust is collected in a common collecting region.

The main body 11 also houses filters (not visible in these drawings) for trapping fine particles in the cleaned airflow. These filters remove any fine particles of dust which have not already been removed from the airflow by the separating apparatus. A first filter, called a pre-motor filter, is provided before the motor and fan. A second filter, called a post-motor filter, is provided after the motor and fan. Where the motor for driving the suction fan has carbon brushes, the post-motor filter also serves to trap any carbon particles emitted by the brushes. Clean air is then expelled to the atmosphere.

The cleaner head 12 is pivotably mounted to the lower end of the main body 11, and serves, in use, to treat the floor surface. In this embodiment, it comprises a housing 18 with a chamber for supporting an agitator in the form of a brush bar 19. The lower, floor-facing side of the chamber has an air inlet slot 20 and the brush bar 19 is rotatably mounted in the chamber such that bristles on the brush bar can protrude through the inlet slot and can agitate the floor surface over which the cleaner head passes. The brush bar 19 is rotatably driven by a dedicated motor 21 positioned on the rear of the cleaner head 12.

Figure 1:
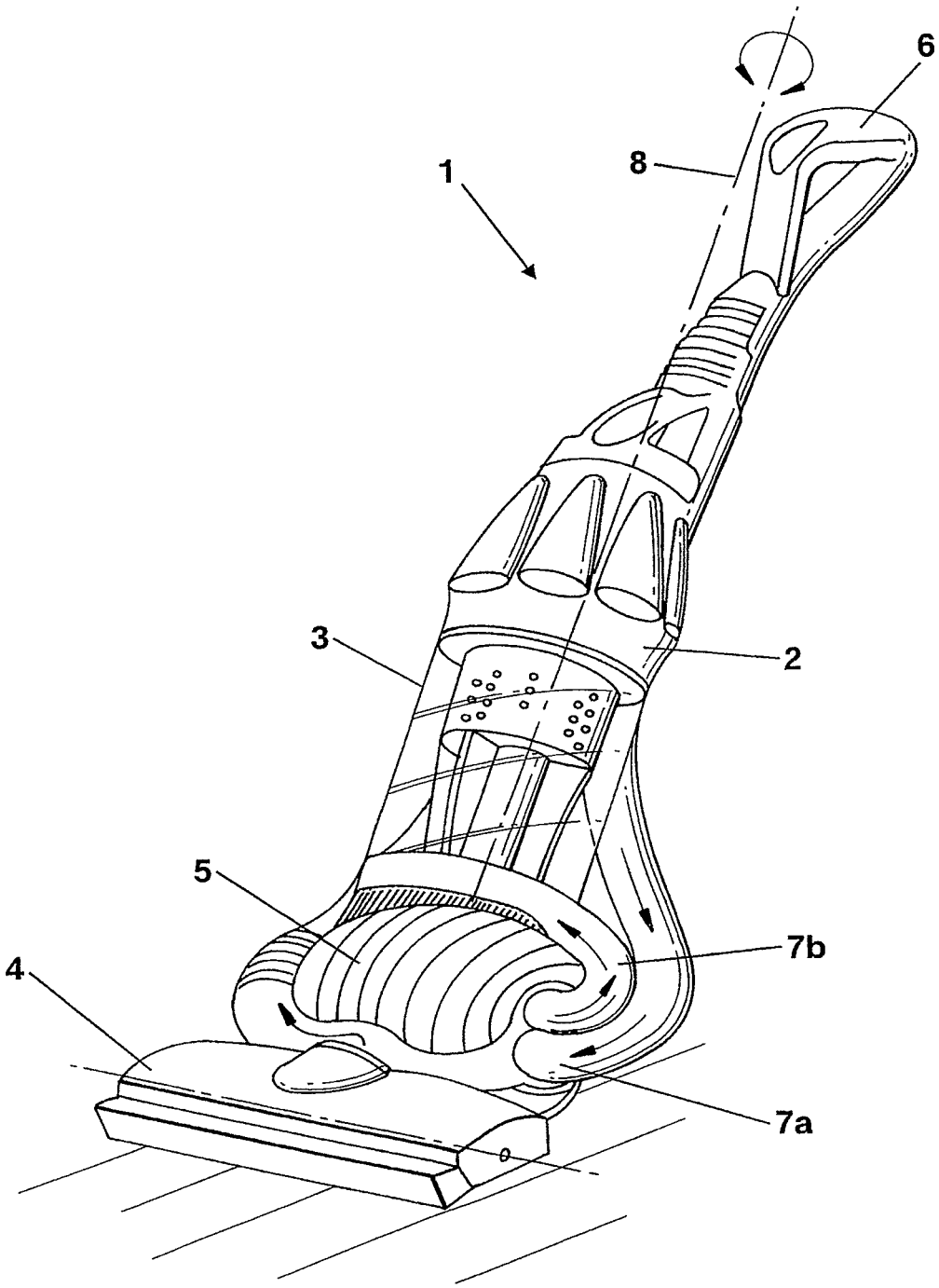
Fig. 1 PRIOR ART
FIG. 1 is a perspective view of a vacuum cleaner incorporating a known type of support assembly.

The rolling support assembly 13 permits the cleaner to be manoeuvred along a floor surface. In order to provide extra support for the cleaner when the main body 11 is in the vertical position, as in FIG. 1, a stand 22 is provided.

A user-operable handle 23 extends upwardly from the rear part of the main body 11. When the cleaner 10 is in the position shown in FIGS. 1 and 2, it can be used in a cylinder mode, in which case the handle 23 may be released and used as a hose and wand assembly. A changeover valve on the main body 11 automatically connects the dust separating apparatus 14 to the wand and hose so that cleaner can be used in cylinder mode for above the floor cleaning. Air is drawn into the cleaner through the end of the wand which can be released from the cleaner for appropriate manipulation. The inlet 20 in the cleaner head 10 is automatically shut off.

When the cleaner 10 is to be used in conventional upright mode, the user reclines the main body 11 whilst depressing a pedal 24 associated with the stand 22. A mechanism on the main body 9 causes the stand 22 to pivot into a position where it lies against the main body, as can be seen in FIG. 3. The changeover valve automatically shuts off the air inlet at the distal end of the wand handle 23 and connects the dust separating apparatus 14 to the inlet 20 in the cleaner head 12.

The cleaner head 12 is connected to the main body 11 of the vacuum cleaner 10 in such a manner that the cleaner head remains in contact with a floor surface as the main body is manoeuvred through a wide range of operating positions, e.g. when moved from side-to-side or when the main body is twisted about its longitudinal axis. A linkage in the form of a yoke 25 forms a connection between the main body 9 and the cleaner head 10. The yoke 25 comprises a shell, which is moulded to incorporate two rotational axes 26, 27. The first axis 26, which extends across the sides of the shell, permits the main body 11 to pivot with respect to the yoke when it is reclined for a cleaning operation in the upright mode. The second axis 27, which depends from the front of the shell, permits the housing 18 of the head 12 to turn with respect to the yoke 25 when the cleaner is being steered along a floor surface. The two axes 26, 27 are transverse to each other. This arrangement permits the cleaner 10 to be more easily manoeuvred than traditional vacuum cleaners.

FIG. 3 shows the vacuum cleaner in a turning position. The user rotates the main body about its longitudinal axis 28 by means of the handle 23. This causes a longitudinal axis of the rolling support assembly 13 to tilt with respect to the floor. The pivoting connections 26, 27 associated with the yoke 25 cause the housing 18 of the cleaner head 12 to turn whilst remaining in contact with the floor. The extent to which the main body 11 is turned about its longitudinal axis 28 determines the extent to which the cleaner head 12 moves from its forward facing position towards the right or left. The stand 22 remains neatly tucked up against the rear of the main body 11 during this range of motions performed by the cleaner 10. This permits the user easily to manoeuvre the cleaner 10, even when cleaning under furniture and other low obstructions.

Figure 4:
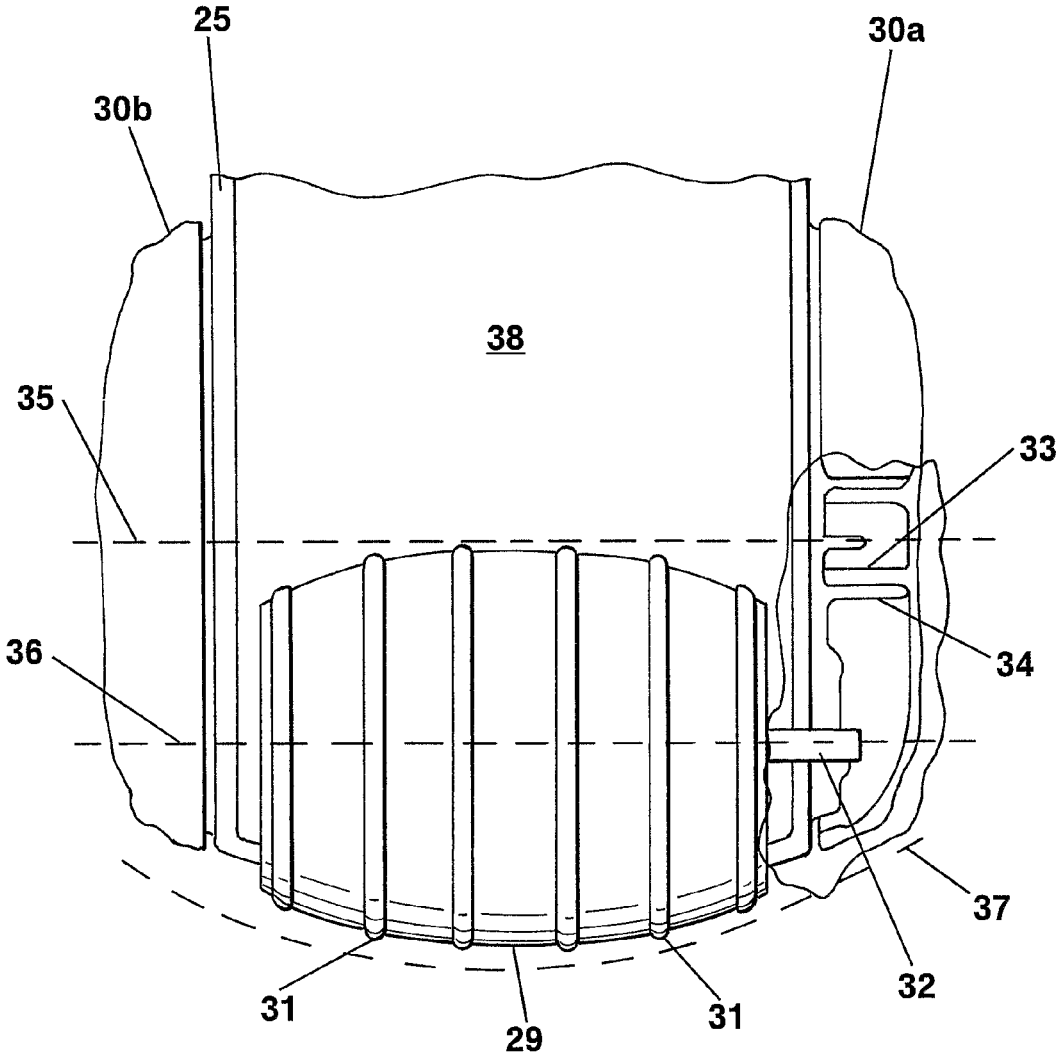
FIG. 4 is a schematic, partly cut-away rear view of the support assembly of FIGS. 2 and 3.

In accordance with the invention, the rolling support assembly 13 comprises a central roller 29 and a pair of outer rollers 30*a*, 30*b*, which are arranged relative to each other so as to provide a rolling support surface, but with rotational axes that are spaced from each other. This arrangement is shown in the partly cut-away schematic drawing of FIG. 4.

Figure 5:
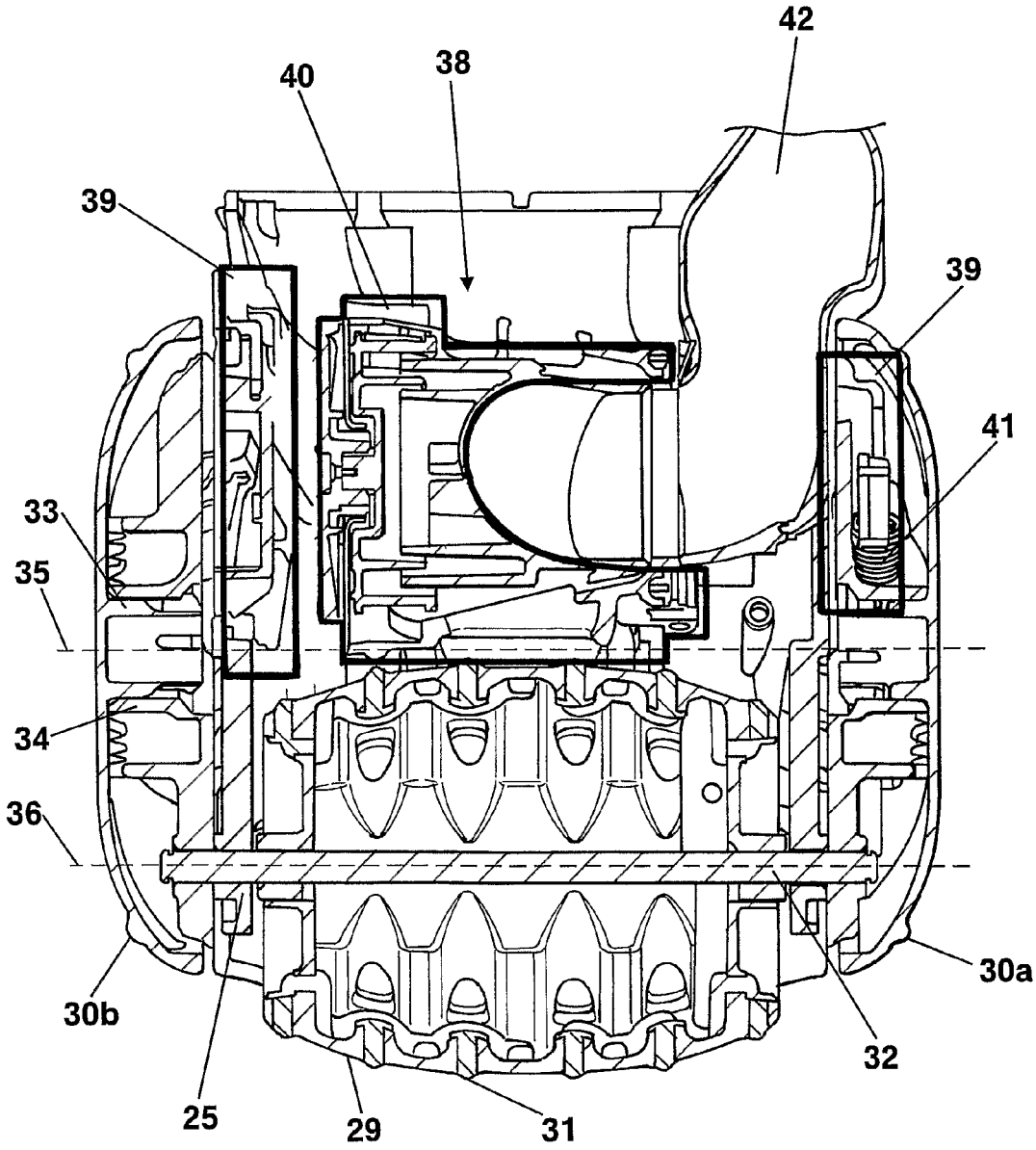
FIG. 5 is a rear view of the support assembly in more detail.
Figure 6:
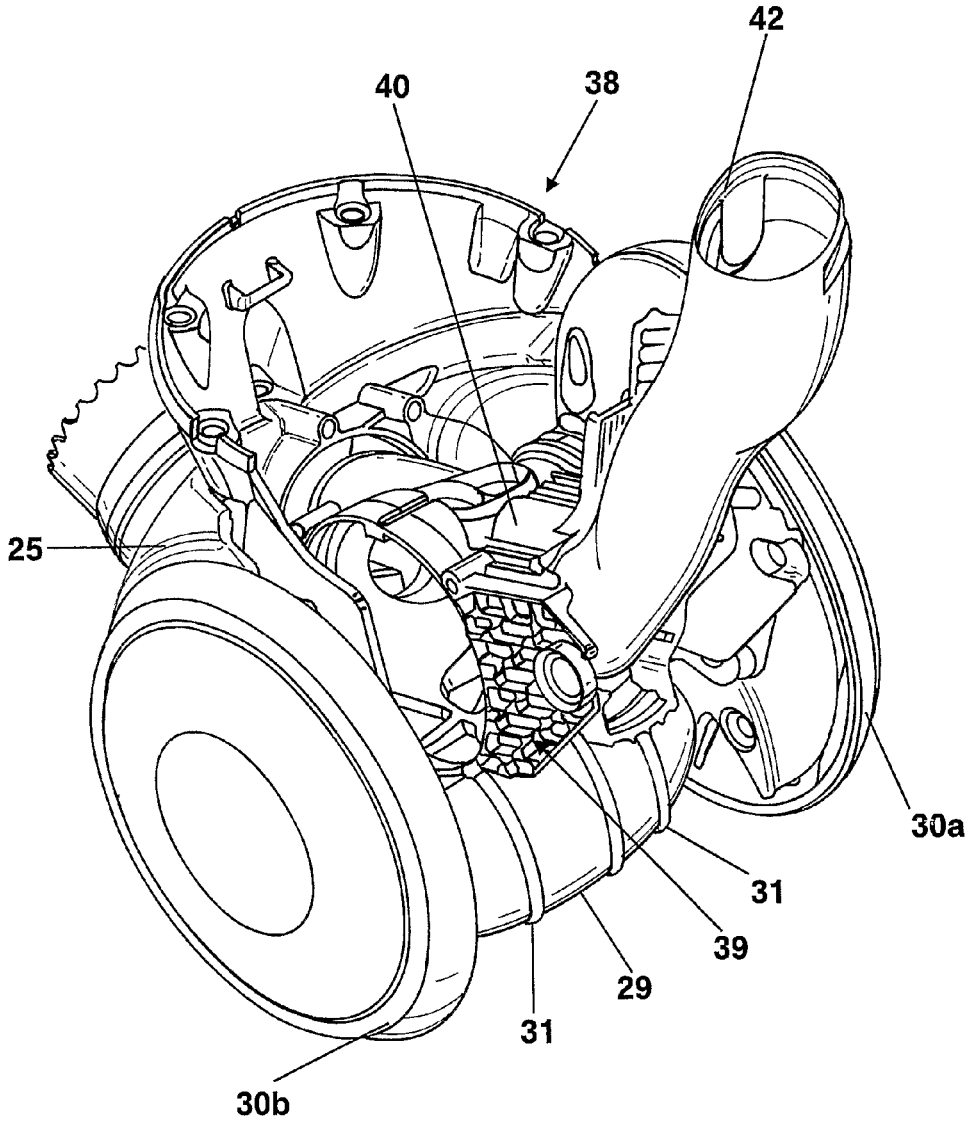
FIG. 6 is a perspective view of the support assembly in detail.
Figure 7:
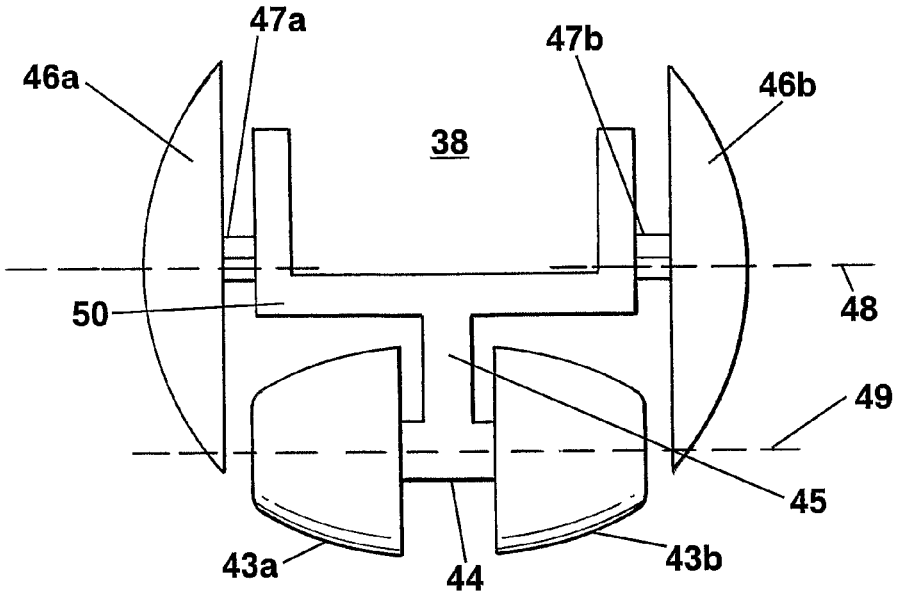
FIGS. 7 to 10 are schematic drawings of an alternative support assemblies constructed according to the invention.

The central roller 29 comprises an elongated and barrel-shaped shell, which shape provides both stability and manoeuvrability. A plurality of ridges 31 are provided around its circumference, equally spaced along its length. The ridges 31 provide extra grip as the support assembly 13 is rolled along a surface to be treated. The central roller 29 is rotatably mounted to the yoke 25 by means of an axle 32. The yoke 25 also rotatably supports the pair of outer rollers, 30*a*, 30*b*, which are mounted adjacent opposite respective ends of the central roller 29. The outer rollers 30*a*, 30*b*, are cap-shaped, having a larger diameter than the maximum diameter of the central roller 29 but a relatively narrow rolling surface. Each of the outer rollers 30*a*, 30*b*, has a collar 33 formed on its inner surface. The collar 33 fits onto a neck 34 formed in the yoke 25 such that the outer roller 30*a* can rotate with respect to the yoke. The outer rollers 30*a*, 30*b*, have a common rotational axis 35 that is spaced from the rotational axis 36 of the central roller 29. In this embodiment, the axes 35, 36 are spaced so that, when the support assembly is in the upright position, with the rotational axes parallel to the floor surface, the rotational axis 35 of the outer rollers 30*a*, 30*b*, is spaced further from the floor than is the rotational axis 36 of the central roller 29. The rollers 29, 30*a*, 30*b*, together define a rolling support surface 37. This arrangement of rollers delimits a region 38 into which components of the vacuum cleaner 10 may be mounted, as is shown in FIGS. 5 and 6.

In these drawings, a plurality of components is mounted within the region 38. A first group 39 of components, mounted adjacent the yoke 25, together form a mechanism for urging the stand between its supporting position and its position against the main body. This mechanism includes a helical spring 41. A second group 40 of components form part of the previously-mentioned changeover valve. Another component in the form of a fluid conduit 42 is also mounted in this region, conveniently adjacent the changeover valve. This conduit 42 provides a fluid flow path between the cleaner head 12 and the main body 11. The arrangement of rollers 29, 30*a*, 30*b*, both protects and hides the components within this region 38. This provides advantages in safety and reliability, as well as being more aesthetically pleasing to the user.

In use, the rolling support assembly 13 provides support for the cleaner 10 over a wide range of movements, as the head 12 is steered over a surface to be treated. Although there is a slight discontinuity of the support surface 37 in the space between the central roller 29 and the adjacent outer roller 30*a* or 30*b*, at least one roller of the support assembly 13 provides support for the cleaner 10 in all positions, even at the extremes of movement.

The arrangement of rollers provides a rolling support assembly having a low central region and higher side regions, which together form a protective envelope for the region 38. When compared with the prior art arrangement of FIG. 1, there is still a wide and supportive rolling surface that enables the cleaner to travel over a surface to be treated. There is also still a region within the volume defined by the rolling support assembly into which components of the cleaner may be mounted. However, the region is not wholly enclosed within the envelope of the rolling support assembly, as was the case with the roller 6 of FIG. 1. It is much more straightforward to connect components of the cleaner located in the region defined by the rollers with other components on the main body of the cleaner. Straightforward mechanical connections and seals may be provided.

Figure 11A:
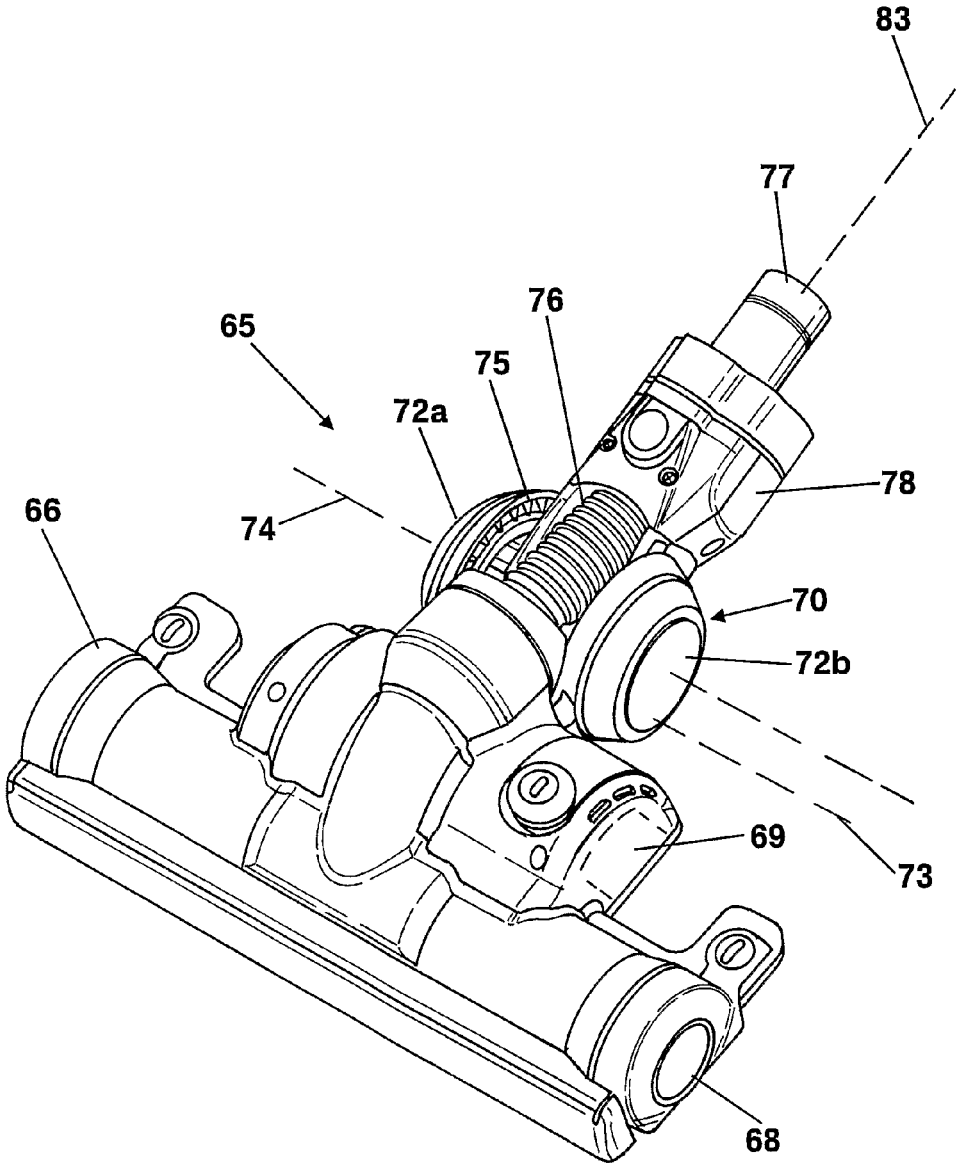
FIG. 11*a* is a perspective view from above of a surface treating head incorporating a support assembly constructed according to the invention.
Figure 11B:
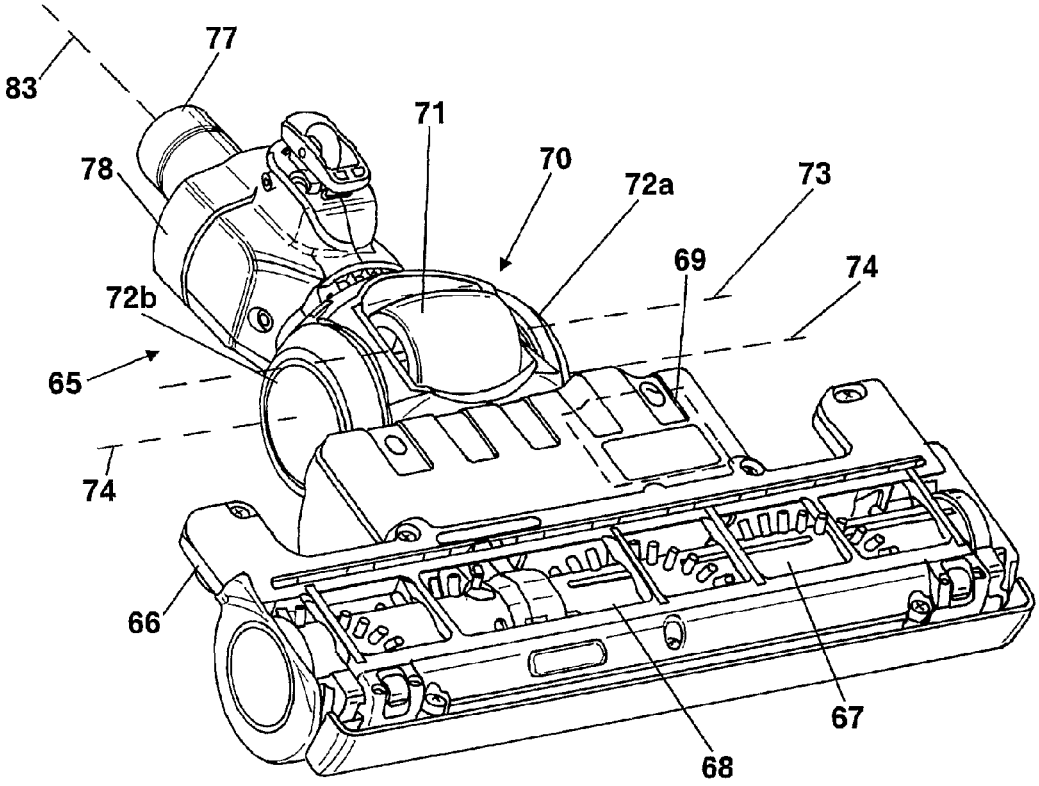
FIG. 11*b* is a perspective view from below of the head of FIG. 11*a;*
Figure 11C:
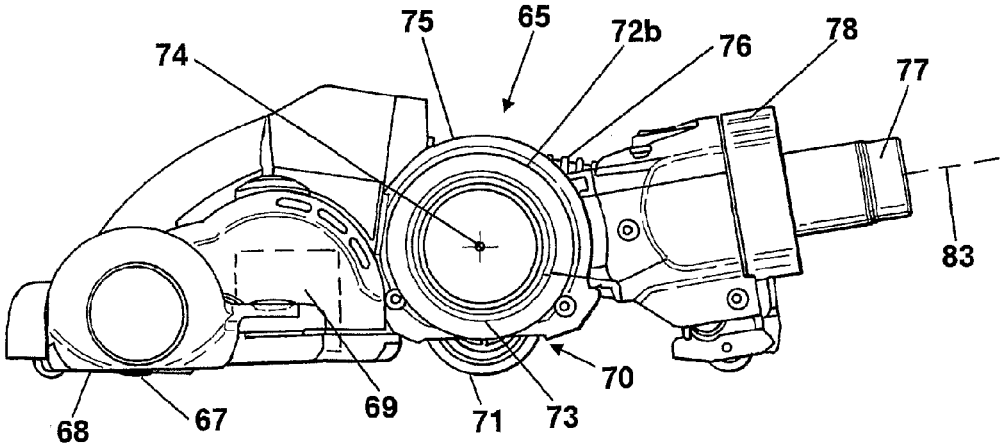
FIG. 11*c* is a side view of the head of FIGS. 11*a* and 11*b*.

FIGS. 11 (*a, b* and *c*) and 12 illustrate a surface treating head, indicated generally by the reference numeral 65, incorporating a support assembly constructed according to the invention. The head 65 comprises a housing 66 with a chamber for supporting an agitator in the form of a brush bar 67. The lower, floor-facing side of the chamber has an air inlet slot 68 and the brush bar 67 is rotatably mounted in the chamber such that bristles on the brush bar can protrude through the inlet slot and can agitate the floor surface over which the surface treating head passes. The brush bar 67 is rotatably driven by a dedicated motor 69 positioned on the rear of the housing 66.

The head 65 further comprises a rolling support assembly 70 arranged to roll with respect to the housing 66, and which permits the head to be manoeuvred along a floor surface. In accordance with the invention, the rolling support assembly 70 comprises a central roller 71 and a pair of outer rollers 72*a*, 72*b*, which are arranged relative to each other so as to provide a rolling support surface. The central roller 71 has a rotational axis 73 that is spaced from the common rotational axis 74 of the outer rollers 72*a*, 72*b*.

The axes 73, 74 are spaced so that, when the support assembly 70 is in the upright position, with the rotational axes parallel to a floor surface, the rotational axis 74 of the outer rollers 72*a*, 72*b*, is spaced further from the floor than is the rotational axis 73 of the central roller 71. This arrangement of rollers delimits a region 75 into which components of the head 65 may be mounted. In this embodiment, a fluid conduit 76 is located. The fluid conduit 76 provides a fluid flow path for air drawn into the head 65 via the air inlet slot 68, so that the air passes to an outlet 77 located on the neck 78 at the rear of the head 65. The neck 78 permits the head 65 to be connected to a wand or hose for a cleaning operation, such as is illustrated in FIG. 12.

Figure 12:
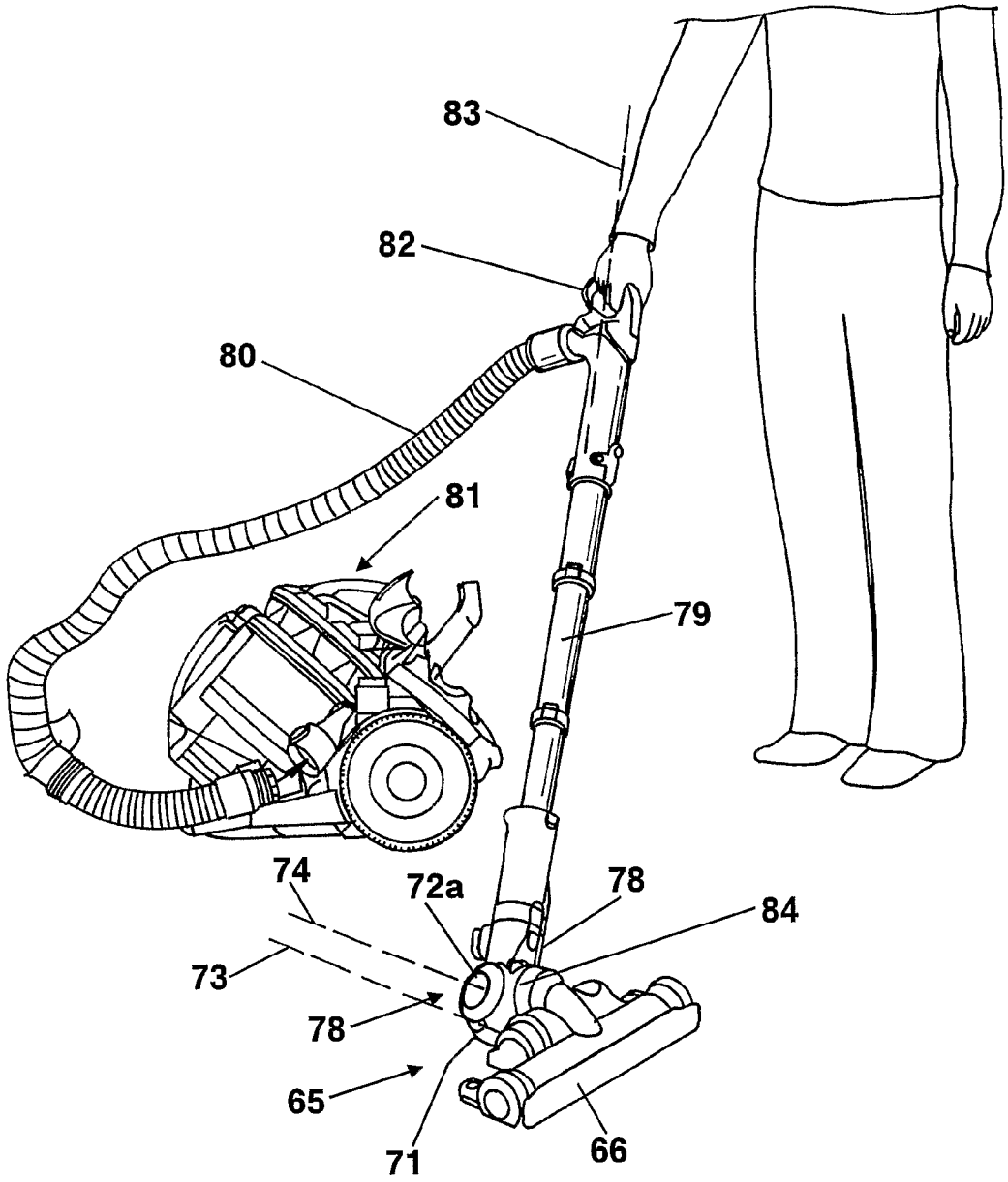
FIG. 12 is a perspective view of the head of FIGS. 11*a, b* and *c* in use.

FIG. 12 shows the head 65 in use. The neck 78 is connected to one end portion of a wand 79 which, in turn, is connected to a hose 80. The hose 80 is connectable to a surface-treating appliance, such as a cylinder vacuum cleaner 81. The wand 79 includes a handle 82, which enables the user to manipulate the wand. In use, the user rotates the neck 78 of the head 65 by rotating the wand 79 about the common longitudinal axis 83 of the neck and wand by means of the handle 82. This causes a longitudinal axis of the rolling support assembly 70 to tilt with respect to the floor. A rotatable joint 84 located between the housing 66 and the rolling support assembly 70 permits the housing of the head 65 to turn whilst remaining in contact with the floor. The extent to which the wand 79, and hence the neck 78 is turned about the longitudinal axis 83 determines the extent to which the head 65 moves from its forward facing position towards the right or left.

FIGS. 7 to 10 schematically illustrate alternative forms that the invention could take. Each roller need not comprise a single rolling member, but may instead be made up of a plurality of rolling members. For example, in FIG. 7, the central roller 43 comprises a pair of wheels 43*a*, 43*b*, mounted on a common axle 44. A strut 45 extends upwardly from the axle 44 between the wheels 43*a*, 43*b*. Each wheel 43*a*, 43*b*, has a larger diameter at the end portion near the strut 45 than at its other end portion adjacent the outer rollers 46*a*, 46*b*, so that the overall profile of the rolling support surface of the wheels 43*a*, 43*b* is approximately barrel-shaped. In this embodiment, the outer rollers 46*a*, 46*b*, comprise caps having partly spherical outer surfaces with rounded ends. Each outer roller 46*a*, 46*b* has its own axle 47*a*, 47*b*, but a common rotational axis 48. This common rotational axis 48 is spaced from the rotational axis 49 of the central roller 43. The axles 44, 47*a* and 47*b* are rotatably mounted to a frame 50, from which the strut 45 extends.

Figure 8:
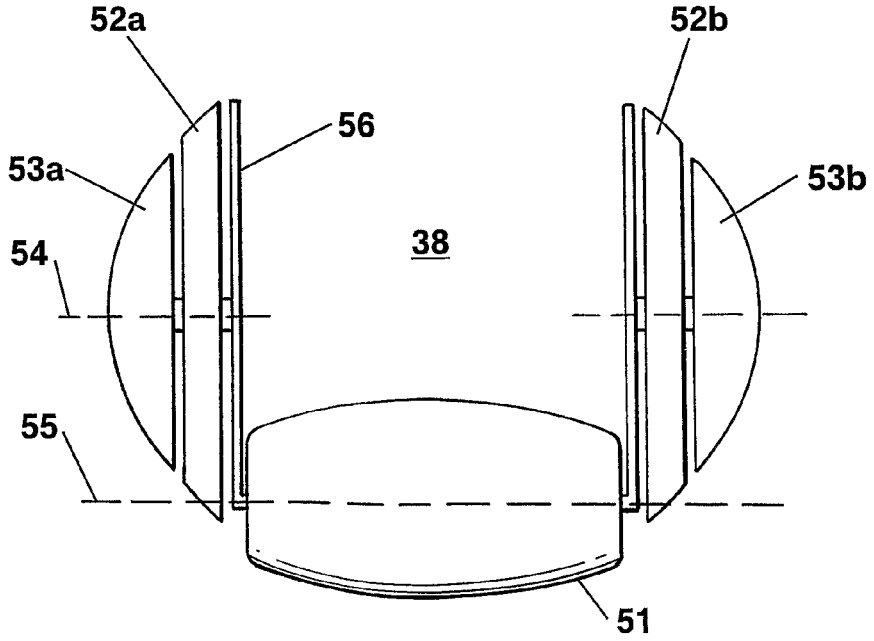
Figure 9:
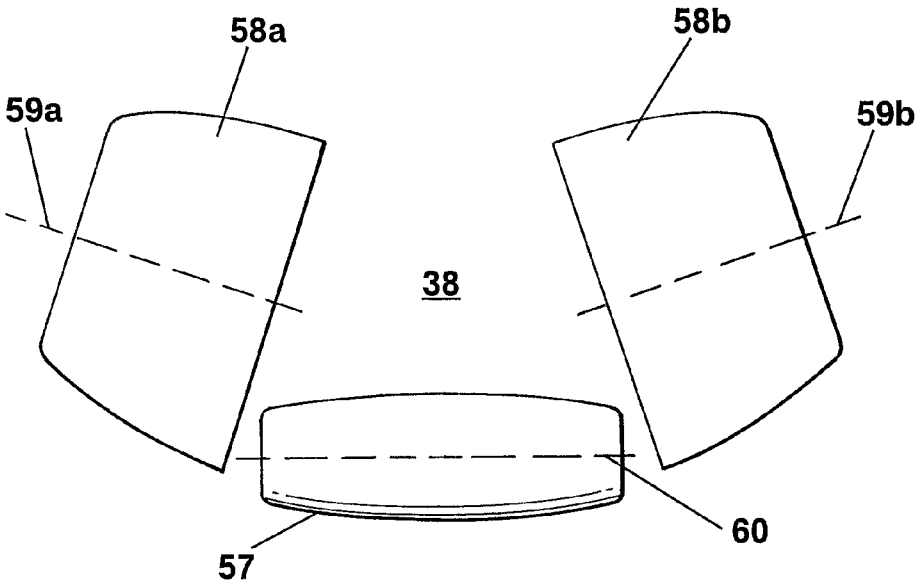

In the embodiment of FIG. 8, the central roller comprises a single elongated rolling member 51. The outer rollers comprise two pairs of roller members. The first pair of outer roller members 52*a*, 52*b*, is provided adjacent each end of the central roller 51. Each roller member 52*a*, 52*b* of the first pair has a tapered surface, with the end portion of larger diameter being adjacent the central roller 51. The other end portions of smaller diameter are adjacent a second pair of roller members 53*a*, 53*b*, in the form of rounded caps. The first and second pairs 52, 53 have a common rotational axis 54, which simplifies assembly of this arrangement, but could, of course, be mounted so as to have separate rotational axes spaced from each other. The rotational axis 54 of the outer rollers 52, 53 is spaced vertically from the rotational axis 55 of the central roller 51 and all of the rollers are mounted on a common frame 56.

The rotational axes of the rollers need not be parallel. In the embodiment shown in FIG. 9, the roller assembly comprises a central elongated roller 57 having a pair of tilted outer rollers 58*a*, 58*b*. Each outer roller 58*a*, 58*b* is approximately half-barrel shaped, with its largest diameter adjacent the central roller 57. The outer rollers 58*a*, 58*b* do not rotate about a common axis but instead have different respective axes 59*a*, 59*b*. Each axis 59*a*, 59*b* is spaced from the rotational axis 60 of the central roller 57 and tilted with respect to it. The axes 59*a*, 59*b* are tilted so that each outer roller 58*a*, 58*b* is tilted toward the central roller 57. Naturally, the outer rollers 58*a*, 58*b* could be tilted so as to be inclined away from the central roller 57. The frame or yoke onto which the rollers may be mounted is not shown in this drawing, nor in FIG. 10.

Figure 10:
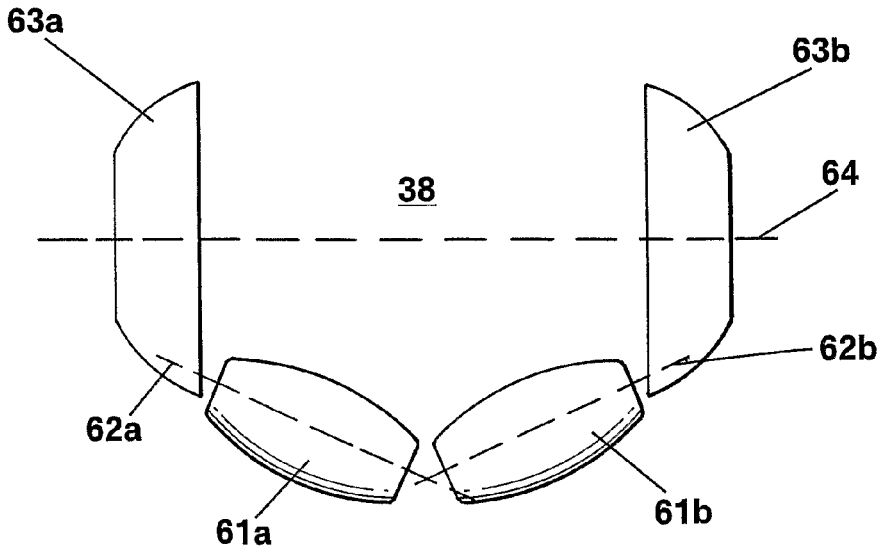

Finally, in the alternative arrangement of FIG. 10, the central roller comprises a pair of barrel-shaped roller members 61*a*, 61*b*. These central members 61*a*, 61*b* do not rotate about a common axis, but instead have separate rotational axes 62*a*, 62*b*, that are inclined with respect to each other. The outer rollers comprise a pair of rotatable caps 63*a*, 63*b* of relatively large diameter. The caps rotate about a common axis 64 that is substantially parallel to a floor surface when the assembly is placed upright on a floor. This arrangement gives good stability when the assembly is steered to the left or right.

Although arrangements have been shown having a pair of outer rollers mounted at respective ends of the central roller, the support assembly may only have one outer roller at one end of the central roller. This solitary outer roller may itself comprise a plurality of rotatable members. This arrangement would be employed in a support assembly arranged to turn predominantly in one direction, or where more support is required at one end of the assembly than the other. In general, a symmetrical arrangement, having outer rollers at both ends of the central roller, is preferred.

While the illustrated embodiment shows a vacuum cleaner in which ducts carry airflow, it will be appreciated that the invention can be applied to vacuum cleaners which carry other fluids, such as water and detergents, as well as other surface-treating appliances.

The invention claimed is:

1. A support assembly for a surface treating appliance or a surface treating head, comprising a plurality of rollers in combination defining a rolling support surface, the rollers comprising a central roller arranged to engage a planar floor surface and a pair of outer rollers at opposite ends of the central roller, each outer roller sharing a common rotational axis spaced from a rotational axis of the central roller and the rotational axis of the central roller passing through each outer roller and being fixed relative to the common rotational axis of the outer rollers.

2. The assembly as claimed in claim 1 wherein, when the support assembly engages a surface such that the rotational axis of the central roller is substantially parallel to the surface, the rotational axis of each outer roller is further above the surface than is the rotational axis of the central roller.

3. The assembly as claimed in claim 1 wherein the maximum diameter of the central roller is smaller than the maximum diameter of each outer roller.

4. The assembly as claimed in claim 1 wherein each outer roller has a smaller diameter at its end portion remote from the central roller than at its end portion adjacent the central roller.

5. The assembly as claimed in claim 1, wherein the central roller has a smaller diameter at each end portion than at the central portion.

6. A surface treating appliance comprising a support assembly, a main body having a longitudinal axis and a surface-treating head, the support assembly comprising a plurality of rollers in combination defining a rolling support surface, the rollers comprising a central roller arranged to engage a planar floor surface and a pair of outer rollers at opposite ends of the central roller, each outer roller sharing a common rotational axis spaced from a rotational axis of the central roller, the rotational axis of the central roller passing through each outer roller and being fixed relative to the common rotational axis of the outer rollers and wherein the support assembly is arranged to roll with respect to the main body for allowing the appliance to be rolled along a surface.

7. The appliance as claimed in claim 6, wherein the rollers of the support assembly delimit a region housing a component.

8. The appliance as claimed in claim 7, wherein the component comprises a fluid flow conduit.

9. The appliance as claimed in claim 6, further comprising a stand moveable between a supporting position, in which it supports the main body, and a stored position.

10. The appliance as claimed in claim 9, further comprising a user-operable pedal arranged on the stand.

11. The appliance as claimed in claim 7, wherein the component comprises a changeover valve arranged to allow fluid flow either from the surface-treating head or from a hose located on the main body.

12. The appliance as claimed in claim 6, wherein at least one rotational axis of the support assembly is transverse to the longitudinal axis of the main body.

13. The appliance as claimed in claim 6, further comprising a linkage between the main body and the surface treating head arranged such that rotating the main body about its longitudinal axis causes the surface treating head to turn in a new direction.

14. The appliance according to claim 13, wherein the linkage is arranged to allow the surface treating head to remain substantially in contact with the surface as the main body is rotated about its longitudinal axis.

15. The surface treating appliance as claimed in claim 6, wherein, when the support assembly engages a surface such that the rotational axis of the central roller is substantially parallel to the surface, the rotational axis of each outer roller at the center of each outer roller is further above the surface than is the rotational axis of the central roller.

16. The surface treating appliance as claimed in claim 6, wherein the maximum diameter of the central roller is smaller than the maximum diameter of each outer roller.

17. The surface treating appliance as claimed in claim 6, wherein each outer roller has a smaller diameter at its end portion remote from the central roller than at its end portion adjacent the central roller.

18. The assembly as claimed in claim 9, wherein the stand comprises a plurality of rollers.

19. The surface treating appliance as claimed in claim 6, wherein the central roller has a smaller diameter at each end portion than at the central portion.

* * * * *